US005354064A

United States Patent [19]

Toikka

[11] Patent Number: 5,354,064

[45] Date of Patent: Oct. 11, 1994

[54] GOLF BALL STRIKING MAT

[75] Inventor: Ari Toikka, Helsinki, Finland

[73] Assignee: Optronics, Ltd., Salt Lake City, Utah

[21] Appl. No.: 3,390

[22] Filed: Jan. 12, 1993

[51] Int. Cl.[5] ..... A63B 69/36

[52] U.S. Cl. ..... 273/195 A; 273/195 R

[58] Field of Search ..... 273/195, 196, 176, 187.1; 428/17

[56] References Cited

U.S. PATENT DOCUMENTS

| | | | |
|---|---|---|---|
| 3,107,920 | 10/1963 | Strunk | 273/195 A |
| 3,323,802 | 6/1967 | Riner | 428/17 |
| 3,348,847 | 10/1967 | Fischl | 273/195 R |
| 3,459,107 | 8/1969 | Anderson | 273/195 A |
| 3,669,454 | 6/1972 | Kolonel | 273/176 F |
| 3,869,127 | 3/1975 | Kohori | 273/187.1 |
| 3,995,079 | 11/1976 | Haas | 273/196 |
| 4,294,450 | 10/1981 | Gallic | 273/176 F |
| 4,497,854 | 2/1985 | Milner | 428/17 |

FOREIGN PATENT DOCUMENTS

| | | | |
|---|---|---|---|
| 156001 | 7/1991 | Japan | 428/17 |
| 3-250106 | 11/1991 | Japan | 428/17 |
| 448839 | 4/1968 | Switzerland | 273/176 F |

*Primary Examiner*—Mark S. Graham

*Attorney, Agent, or Firm*—Thorpe, North & Western

[57] ABSTRACT

A brush mat for simulating a grass rough and on which golf balls are placed for practice hitting by a golfer. The mat includes numerous upstanding fibers, simulating grass, in which the upper surface defined by the upper ends of the fibers is generally planar, except for one or more hollows formed in the upper surface. The hollow or hollows have selected depths to receive and hold golf balls, from which location or locations the ball would be hit. Providing different depths for the hollows in which the balls are placed, allows for simulating different rough conditions since the golf ball will protrude above the upper generally planar surface different distances for the different depth hollows.

2 Claims, 5 Drawing Sheets

GOLF BALL STRIKING MAT

BACKGROUND OF THE INVENTION

This invention relates to a striking mat for use in practicing golf strokes. The striking mat is constructed to simulate grass and what golfers call the "rough", having a raised material substituting for grass, on the surface of which a golf ball is placed for hitting or striking. The invention is intended to create realistic conditions, especially for simulating and practicing strokes from the rough.

The golf simulators and/or golf stroke practicing mats presently in use primarily use a thick mat or so-called Tee Grass, which has densely placed erect plastic fibers, so that when the golf ball is placed on the fibers, it does not sink into the fibers at all. This, however, corresponds more to the situation on the so-called fairways (with their shorter, groomed grass), which provide a fairly good hitting base, than to a rough with its longer grass. For this reason, in modern golf game simulator machines, an effort is made to "penalize" strokes made from the rough by restricting the choice of clubs by special rules, or alternatively the machine deducts a percentile amount of the length of the stroke or hit from shots made from the rough. In such a situation, however, the player does not encounter the same difficulties or "real" golfing feel as when striking from the rough on a real golf course, and the feel of striking and practicing remains unsatisfactory.

When a golf ball is in the rough, it is in deeper grass, and before hitting the ball, the golf club head has to travel through a larger amount of grass than in fairway conditions to reach the ball. The travelling of the club head through the grass slows down its speed, impairs the functioning of the shaft and thus makes it difficult to get a proper strike at the ball. All these factors impair the length and accuracy of the hit ball. It is thus an object of the present invention to provide a golf ball hitting or striking mat that offers a natural-feeling striking base, and enhances the realistic feel when used in a golf simulator environment, for practicing strokes from the rough.

SUMMARY OF THE INVENTION

In order to achieve the objective of the invention, it is characteristic of the present invention that a suitable hollow or depression for receiving and holding a golf ball is formed in the surface of a brush or grass mat, so that, before hitting the ball, the golf club head has to push aside the brush or grass material (of which the mat is made) in front of the ball in the path of the club head. By providing a hollow of this kind, the ball can be placed in the desired way in the brush or grass, depending on the size and shape of the hollow, to provide a mat more realistic and similar to hitting from the rough. In addition to practicing striking or hitting from the rough, a striking mat such as this may also be used for practicing (simulating) strokes from a bunker, for example, by providing a brush or grass surface slightly less dense than that used for practicing strokes from the rough.

BRIEF DESCRIPTION OF THE DRAWINGS

In the following, the invention is explained with reference to the attached drawings, in which.

DETAILED DESCRIPTION

Figure 1:
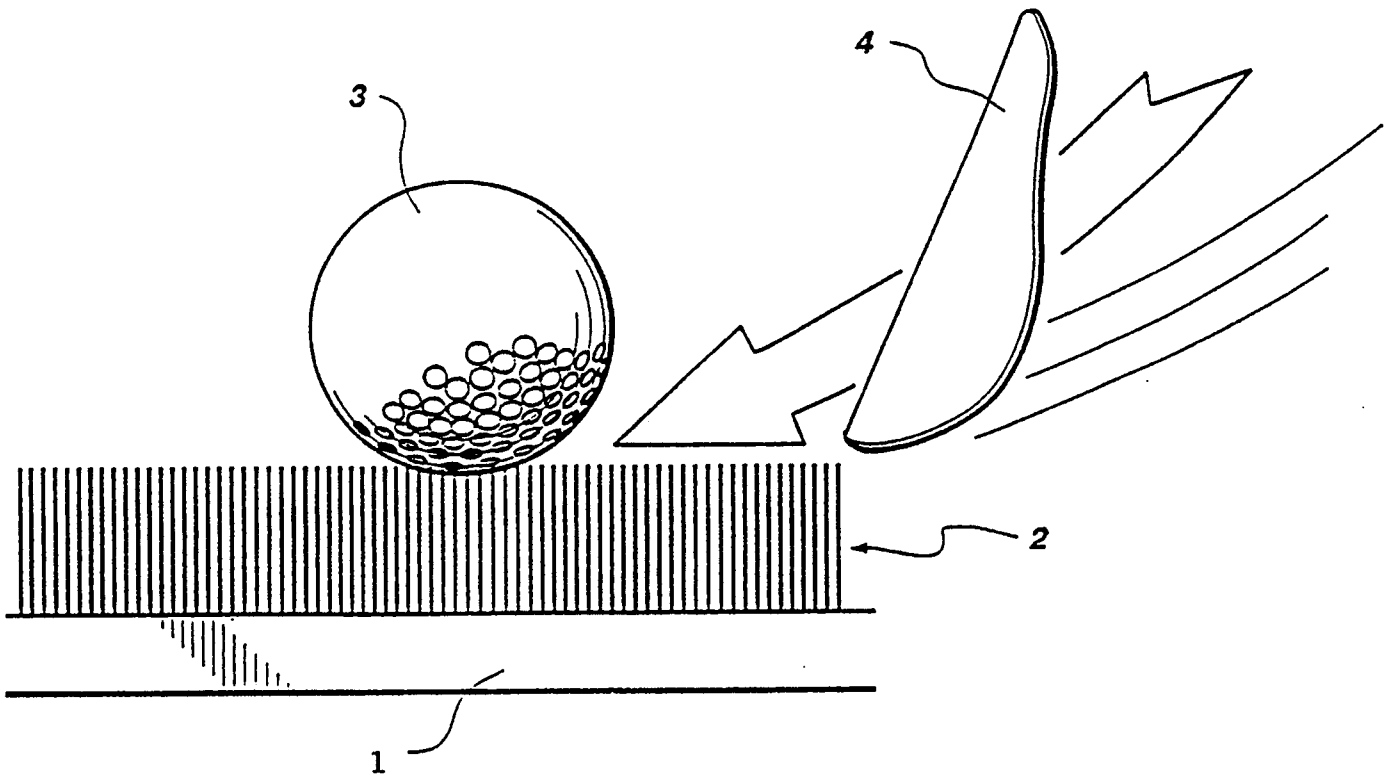
Fig. 1 PRIOR ART
FIG. 1 shows a side, elevational view of a striking mat according to the prior art.

In accordance with FIG. 1, presently available striking mats are usually formed of a base 1, on which a dense, synthetic brush or grass matting or surface 2 has been formed of upstanding erect plastic fibers. When a ball 3 is placed on the dense grass surface 2, it hardly sinks into the surface at all, so that a golf club blade 4 hits the ball almost unobstructed. This kind of mat corresponds fairly well to real fairway conditions, but it is not suitable for practicing strokes from the rough or from a bunker. The mat construction of FIG. 1 is conventional and well known.

The mat of the present invention (FIGS. 2–5) is formed, correspondingly, of a brush or grass matting or surface 2 made from raised fibers of plastic or other suitable material on a base 1. A depression or hollow 5 is formed in the grass surface 2, for example, by cutting or initially forming, in which hollow a golf ball 3 is placed for hitting. When hitting the ball 3, a golf club head 4 touches the grass surface 2 around the hollow 5, thus corresponding closely to and simulating the situation when striking or hitting a golf ball from the rough.

Figure 2:
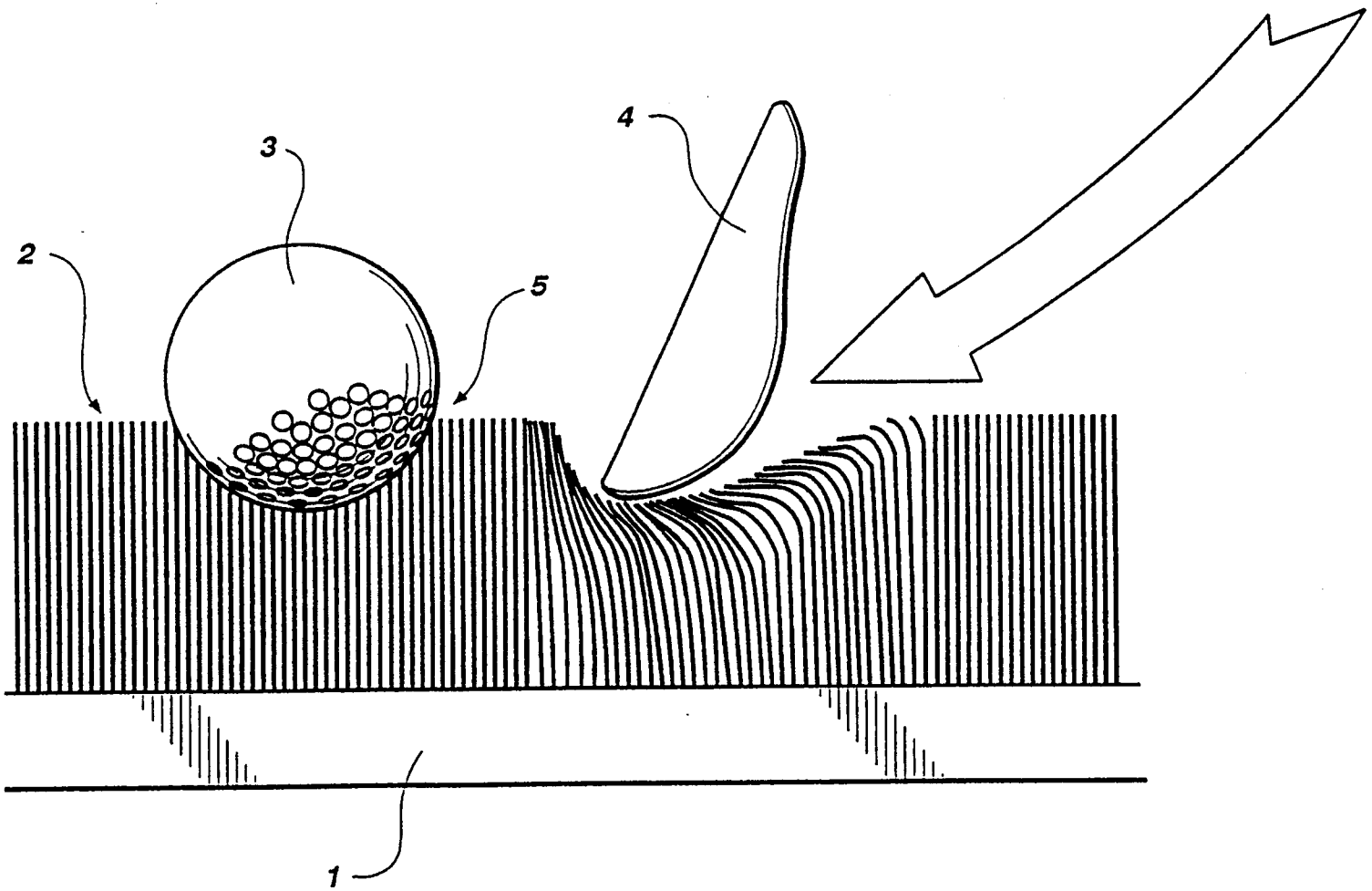
FIGS. 2, 3*a*, 3*b*, 3*c* and 3*d* show side, elevational views of different embodiments of striking mats made in accordance with the invention.
Figure 3B:
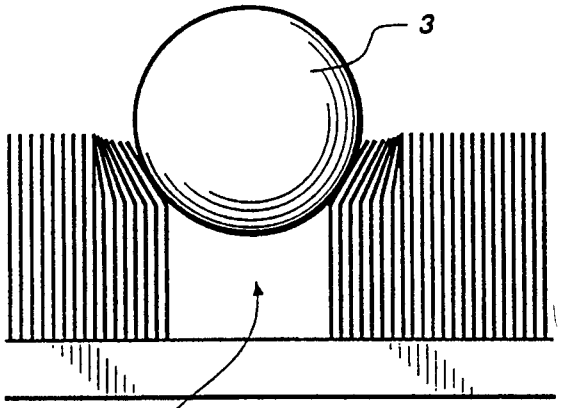
Figure 3D:
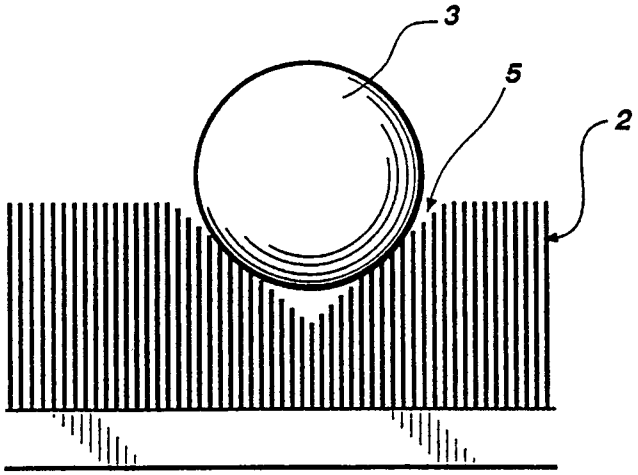
Figure 3A:
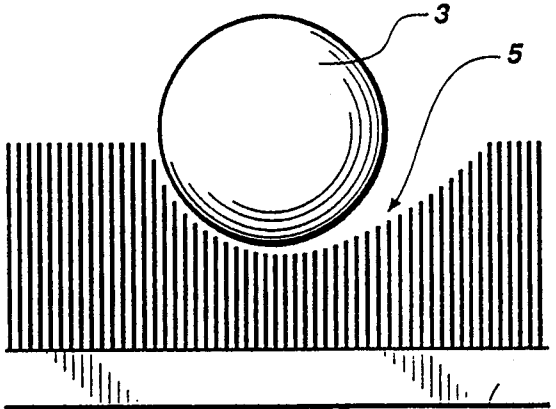
Figure 3C:
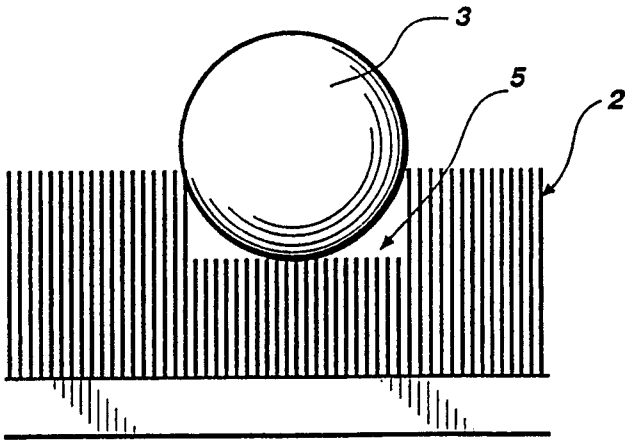
Figure 4:
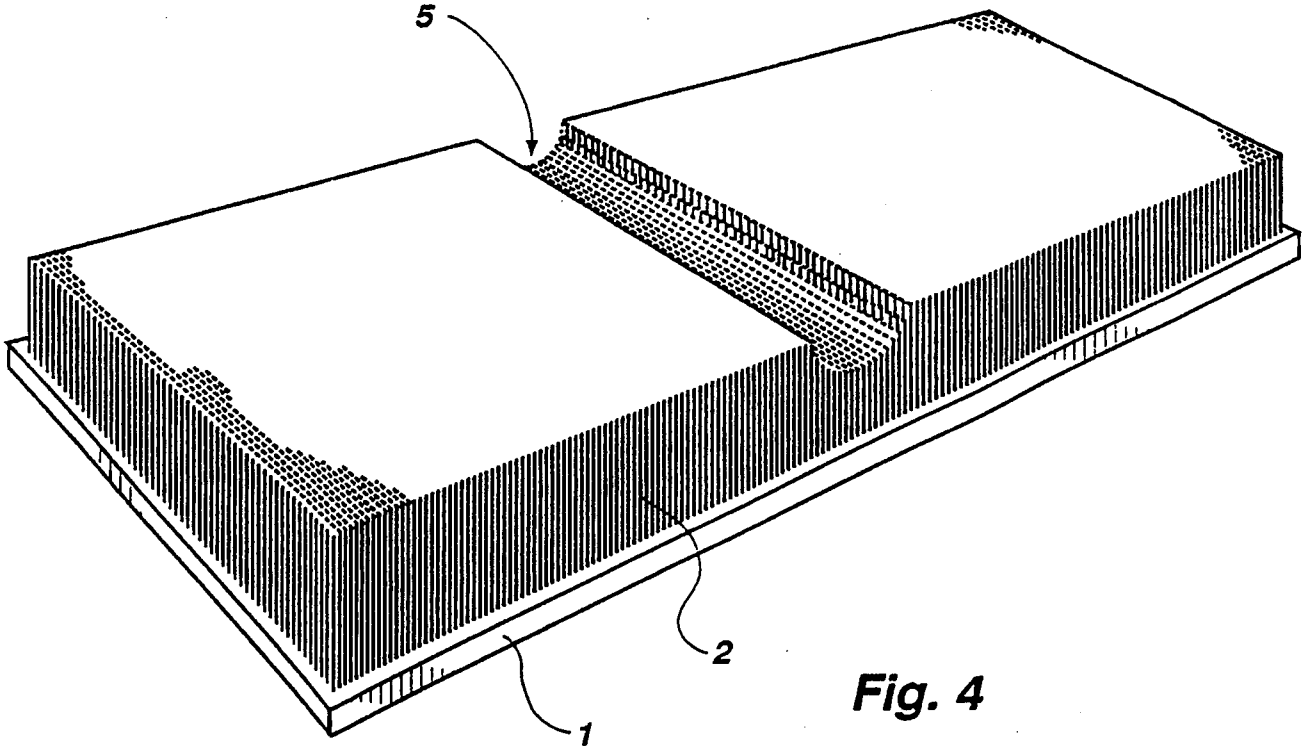
FIG. 4 shows a perspective view of an embodiment of a striking mat made in accordance with the present invention.

The side, cross-sectional shape of the hollow 5 of FIG. 2 is partly spherical, to generally conform to the shape of the ball 3. FIGS. 3A through 3D show certain alternative side, cross-sectional shapes for the hollow 5. For example, FIG. 3A shows a hollow 5 which conforms to one side of the golf ball 3, but which extends away and is spaced from the other side of the ball which, if it is the hitting side, provides less resistance to the golf club head reaching the ball. FIG. 3B shows the hollow 5 to be formed with no fibers in a certain area directly under the ball 3, but with fibers surrounding the hollow being bent aside to hold the ball. FIG. 3C shows the hollow 5 about the width of a golf ball being formed with a flat, rather than spherical, bottom and a generally rectangular cross-section. Finally, FIG. 3D shows the hollow 5 as having an inverse conical shape.

Figure 5:
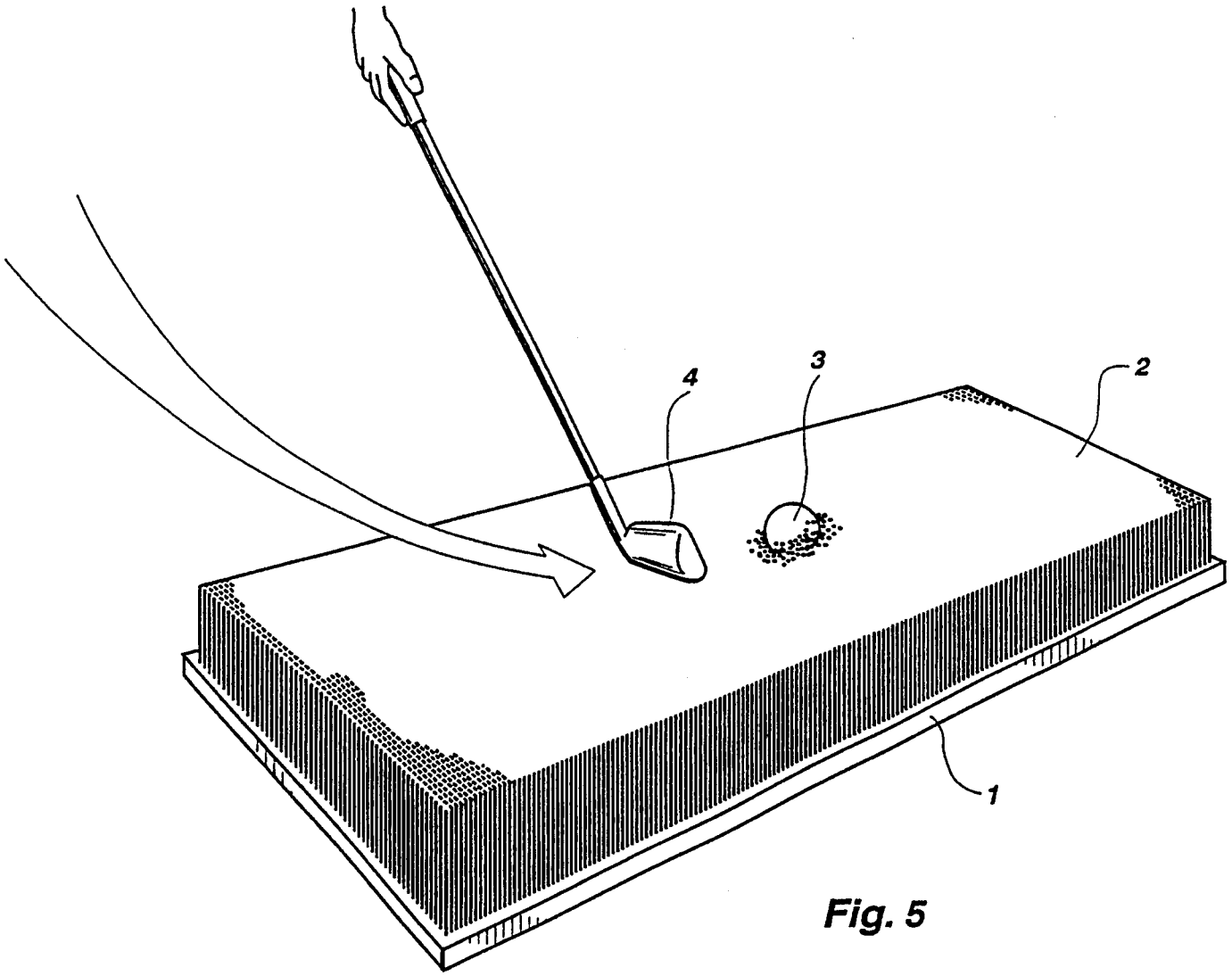
FIG. 5 shows a perspective view of another embodiment of a striking mat made in accordance with the present invention.

Hollow 5 may, for example, also be formed to extend partly or wholly across the grass surface 2 (FIG. 4) or only to surround the golf ball 3 to the appropriate extent (FIG. 5). By using, for example, a less dense grass surface and selected hollow shapes and depths, the mat can be made to simulate various densities of a rough, and also bunkers.

In the context of this application, the term "grass surface" has been used only to describe that surface of the striking mat, on which the ball is placed for the stroke, so that the same term has been used in connection with the striking mats for rough and bunker shots. This grass surface is formed from appropriate, raised material, such as, for example, various fiber or thread materials which can be straight or shaped in an appropriate way, for example, to form the desired hollow.

I claim:

1. A striking mat for use in practicing golf strokes, said mat having an artificial grass surface of erect fibers, on which a golf ball is placed for striking, characterized in that a hollow for receiving and holding the ball is formed in the grass surface of the mat, so that a golf club, before striking the ball, has to push aside said fibers in front of the ball in the path of the club, the hollow having generally vertical sides defined by taller erect fibers, and a bottom side formed by shorter erect fibers, a width across the hollow being a distance about the diameter of a golf ball.

2. A striking mat for use in practicing golf strokes as in claim 1, wherein the hollow has a rectangular shaped cross-section.

* * * * *